US011056046B2

(12) United States Patent
Lee et al.

(10) Patent No.: US 11,056,046 B2
(45) Date of Patent: Jul. 6, 2021

(54) DISPLAY DEVICE AND DRIVING METHOD THEREOF

(71) Applicant: Samsung Display Co., Ltd., Yongin-si (KR)

(72) Inventors: Min Ku Lee, Yongin-si (KR); Ji Hyun Ka, Yongin-si (KR); Eun Ju Kim, Yongin-si (KR); Kwang Sae Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 12 days.

(21) Appl. No.: 16/684,107

(22) Filed: Nov. 14, 2019

(65) Prior Publication Data

US 2020/0160779 A1 May 21, 2020

(30) Foreign Application Priority Data

Nov. 15, 2018 (KR) ..... 10-2018-0141107

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01)

(58) Field of Classification Search
CPC ..... G09G 2310/0267; G09G 2310/0275
See application file for complete search history.

(56) References Cited

U.S. PATENT DOCUMENTS

| | | | | |
|---|---|---|---|---|
| 8,330,684 | B2 | 12/2012 | Park et al. | |
| 9,613,567 | B2 | 4/2017 | Okuno et al. | |
| 2006/0156118 | A1* | 7/2006 | Shin | G09G 3/20 714/726 |
| 2009/0033651 | A1* | 2/2009 | Okamoto | G09G 3/3283 345/214 |
| 2013/0100909 | A1 | 4/2013 | Zhang et al. | |
| 2015/0170568 | A1* | 6/2015 | Lee | G09G 3/3233 345/690 |

FOREIGN PATENT DOCUMENTS

| | | | |
|---|---|---|---|
| KR | 10-0857672 | B1 | 9/2008 |
| KR | 10-2014-0075631 | A | 6/2014 |
| KR | 10-1405657 | B1 | 6/2014 |
| KR | 10-2017-0080218 | A | 7/2017 |

* cited by examiner

*Primary Examiner* — Sejoon Ahn
(74) *Attorney, Agent, or Firm* — Lewis Roca Rothgerber Christie LLP

(57) ABSTRACT

A display device includes: a data line; a first scan line configured to sequentially receive a first scan pulse and a second scan pulse, each of which has a turn-on level; an emission line configured to sequentially receive a first emission pulse, a second emission pulse, a third emission pulse, and a fourth emission pulse, each of which has a turn-on level; and a pixel configured to receive the data signal according to the first and second scan pulses, the pixel being further configured to emit light based on the received data signal according to the first to fourth emission pulses, wherein the first emission pulse is generated before the first scan pulse, the second emission pulse and the third emission pulse are generated in a period between the first scan pulse and the second scan pulse, and the fourth emission pulse is generated after the second scan pulse.

15 Claims, 12 Drawing Sheets

DISPLAY DEVICE AND DRIVING METHOD THEREOF

CROSS-REFERENCE TO RELATED APPLICATION

The present application claims priority to and the benefit of Korean patent application number 10-2018-0141107 filed on Nov. 15, 2018, the entire disclosure of which is incorporated herein in its entirety by reference.

BACKGROUND

1. Field

Various embodiments of the present disclosure relate to a display device and a driving method thereof.

2. Related Art

With the development of information technology, the importance of a display device, which is a connecting medium between information and users, is being emphasized. Accordingly, the use of display devices, such as liquid crystal display devices, organic light-emitting display devices, plasma display devices, and the like, is increasing.

A display device transmits data signals to respective pixels through data lines and makes the respective pixels emit light. Each of the pixels emits light with luminance corresponding to the received data signal. A displayed image may be represented using a combination of light emitted by these pixels.

However, in the event of a change in the voltage of a data line when a pixel emits light, the voltage of the received data signal is changed by parasitic capacitance between the pixel and the data line, which may cause a display defect.

The Background section of the present Specification includes information that is intended to provide context to example embodiments, and the information in the present Background section does not necessarily constitute prior art.

SUMMARY

Aspects of some example embodiments of the present disclosure are directed to a display device and a driving method thereof that may reduce display defects in spite of parasitic capacitance between a data line and a pixel.

According to some example embodiments of the present disclosure, a display device includes: a data line configured to receive a data signal; a first scan line configured to sequentially receive a first scan pulse and a second scan pulse, each of which has a turn-on level; an emission line configured to sequentially receive a first emission pulse, a second emission pulse, a third emission pulse, and a fourth emission pulse, each of which has a turn-on level; and a pixel configured to receive the data signal according to the first and second scan pulses, the pixel being further configured to emit light based on the received data signal according to the first to fourth emission pulses, wherein the first emission pulse is generated before the first scan pulse, the second emission pulse and the third emission pulse are generated in a period between the first scan pulse and the second scan pulse, and the fourth emission pulse is generated after the second scan pulse.

According to some embodiments, a period between the first emission pulse and the second emission pulse is a first non-emission period, a period between the second emission pulse and the third emission pulse is a second non-emission period, and a period between the third emission pulse and the fourth emission pulse is a third non-emission period.

According to some embodiments, the second non-emission period is longer than each of the first non-emission period and the third non-emission period.

According to some embodiments, a length of the first non-emission period is equal to a length of the third non-emission period.

According to some embodiments, the pixel includes: a first transistor having a gate electrode coupled to the first scan line and a first electrode coupled to the data line; a storage capacitor having a first electrode coupled to a first power line; a second transistor having a gate electrode coupled to a second electrode of the storage capacitor and a first electrode coupled to a second electrode of the first transistor; a third transistor having a gate electrode coupled to the first scan line, a first electrode coupled to the gate electrode of the second transistor, and a second electrode coupled to a second electrode of the second transistor; and a fourth transistor having a gate electrode coupled to the emission line, a first electrode coupled to the first power line, and a second electrode coupled to the first electrode of the second transistor.

According to some embodiments, the display device further includes: a second scan line configured to sequentially receive a third scan pulse and a fourth scan pulse, each of which has a turn-on level, wherein the pixel is configured to initialize the received data signal in response to the third and fourth scan pulses, and wherein the third scan pulse is generated in the first non-emission period, and the fourth scan pulse is generated in the third non-emission period.

According to some embodiments, the pixel further includes: a fifth transistor having a gate electrode coupled to the second scan line, a first electrode coupled to the gate electrode of the second transistor, and a second electrode coupled to an initialization power line; a sixth transistor having a gate electrode coupled to the emission line and a first electrode coupled to the second electrode of the second transistor; and a light-emitting diode having an anode coupled to a second electrode of the sixth transistor and a cathode coupled to a second power line.

According to some embodiments, the pixel further includes: a seventh transistor having a gate electrode coupled to the second scan line, a first electrode coupled to the initialization power line, and a second electrode coupled to the anode of the light-emitting diode.

According to some embodiments, the first scan pulse and the second scan pulse are generated at intervals of one frame, the first emission pulse and the third emission pulse are generated at intervals of one frame, and the second emission pulse and the fourth emission pulse are generated at intervals of one frame.

According to some embodiments, in the emission line, a fifth emission pulse is generated before the first emission pulse, a sixth emission pulse and a seventh emission pulse are sequentially generated in a period between the second emission pulse and the third emission pulse, and an eighth emission pulse is generated after the fourth emission pulse.

According to some embodiments of the present disclosure, in a driving method of a display device, the method includes: applying a first emission pulse having a turn-on level to an emission line such that a pixel emits light; applying a first scan pulse having a turn-on level to a first scan line such that the pixel receives a data signal of a data line; applying a second emission pulse and a third emission pulse, each of which has a turn-on level, to the emission line such that the pixel emits light based on the received data signal; applying a second scan pulse having a turn-on level to the first scan line such that the pixel receives the data signal; and applying a fourth emission pulse having a turn-on level to the emission line such that the pixel emits light based on the received data signal, wherein the first emission pulse is generated before the first scan pulse, wherein the second emission pulse and the third emission pulse are generated in a period between the first scan pulse and the second scan pulse, and wherein the fourth emission pulse is generated after the second scan pulse.

According to some embodiments, a period between the first emission pulse and the second emission pulse is a first non-emission period, a period between the second emission pulse and the third emission pulse is a second non-emission period, and a period between the third emission pulse and the fourth emission pulse is a third non-emission period.

According to some embodiments, the second non-emission period is longer than each of the first non-emission period and the third non-emission period.

According to some embodiments, a length of the first non-emission period is equal to a length of the third non-emission period.

According to some embodiments, the method further includes: sequentially applying a third scan pulse and a fourth scan pulse, each of which has a turn-on level, to a second scan line that differs from the first scan line such that the pixel initializes the received data signal, wherein the third scan pulse is generated in the first non-emission period, and wherein the fourth scan pulse is generated in the third non-emission period.

According to some embodiments, the first scan pulse and the second scan pulse are generated at intervals of one frame, the first emission pulse and the third emission pulse are generated at intervals of one frame, and the second emission pulse and the fourth emission pulse are generated at intervals of one frame.

According to some embodiments, the method further includes: generating a fifth emission pulse, a sixth emission pulse, a seventh emission pulse, and an eighth emission pulse in the emission line, wherein the fifth emission pulse is generated before the first emission pulse, the sixth emission pulse and the seventh emission pulse are sequentially generated in a period between the second emission pulse and the third emission pulse, and the eighth emission pulse is generated after the fourth emission pulse.

DETAILED DESCRIPTION

Figure 1:
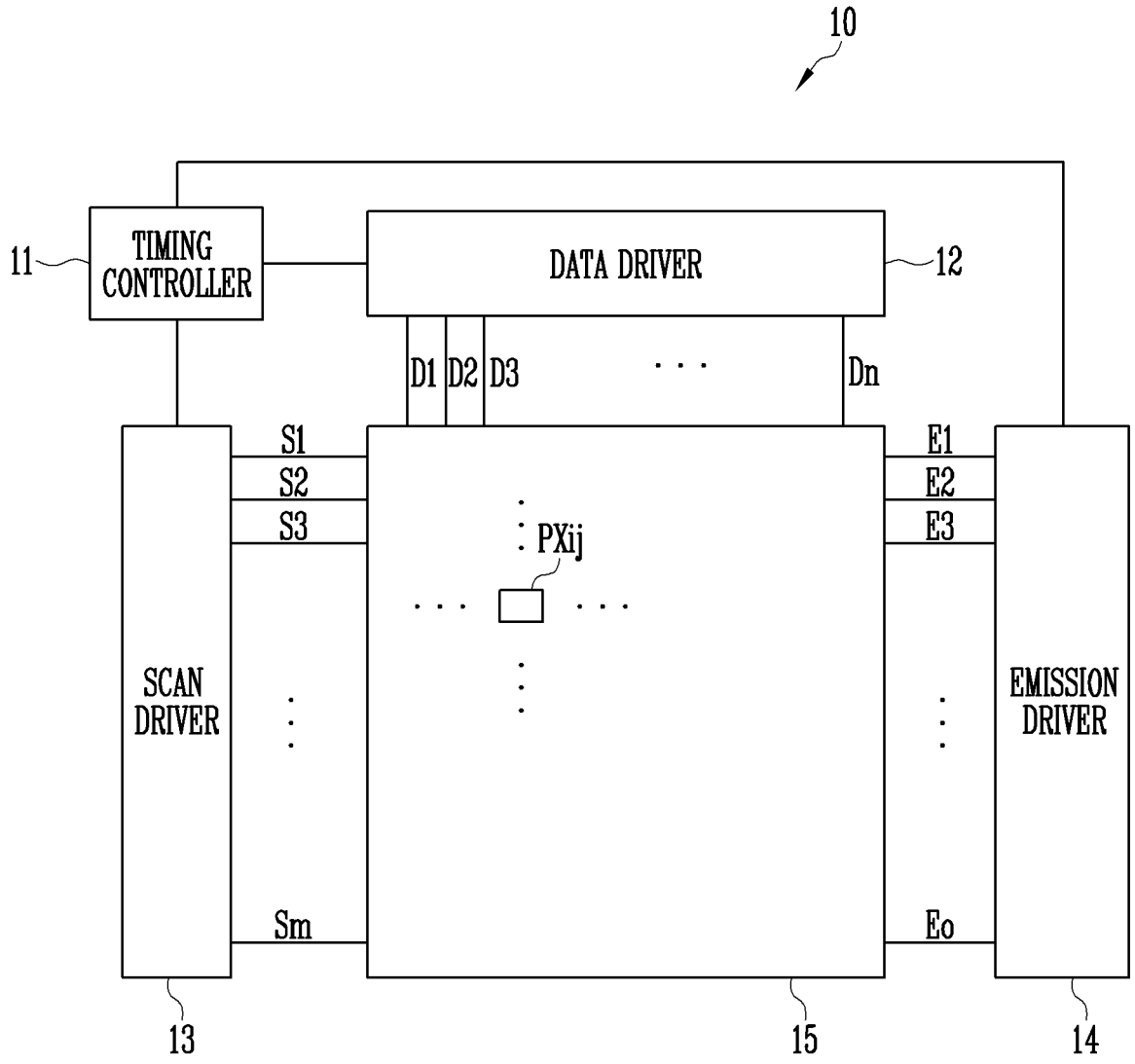
FIG. 1 is a diagram illustrating a display device according to some example embodiments of the present disclosure.

Hereinafter, aspects of some example embodiments of the present disclosure will be described with reference to the accompanying drawings in more detail so that those having ordinary knowledge in the technical field to which the present disclosure pertains can more easily practice the embodiments. The present disclosure may be embodied in different forms and should not be construed as being limited to the embodiments set forth herein.

In order to more clearly explain aspects of the present disclosure, description of certain parts may be omitted, and like reference numerals denote like parts throughout this specification. Accordingly, previously used reference numerals may be used in different drawings.

Because the size and thickness of each configuration shown in the drawings are arbitrarily shown for better understanding and ease of description, the present disclosure is not limited thereto. In the drawings, the thickness of layers and regions may be exaggerated for clarity.

FIG. 1 is a diagram illustrating a display device according to some example embodiments of the present disclosure.

Referring to FIG. 1, the display device 10 according to some example embodiments of the present disclosure may include a timing controller 11, a data driver 12, a scan driver 13, an emission driver 14, and a pixel unit 15.

The timing controller 11 may provide grayscale values, a control signal, and the like to the data driver 12. Also, the timing controller 11 may provide a clock signal, a control signal, and the like to the scan driver 13. Also, the timing controller 11 may provide a clock signal, a control signal, and the like to the emission driver 14.

The data driver 12 may generate data signals to be provided to data lines D1, D2, D3, . . . , Dn using grayscale values, a control signal, and the like, which are received from the timing controller 11. For example, the data driver 12 may sample the grayscale values using a clock signal and apply data signals, corresponding to the grayscale values, to the data lines D1 to Dn in units of pixel rows. Here, n may be a natural number greater than zero.

The scan driver 13 may receive a clock signal, a control signal, and the like from the timing controller 11 and generate scan signals to be provided to scan lines S1, S2, S3, . . . , Sm. For example, the scan driver 13 may sequentially provide scan signals, each having a turn-on level pulse, to the scan lines S1 to Sm. For example, the scan driver 13 may generate scan signals such that a turn-on level pulse is sequentially delivered to the next stage circuit depending on a clock signal. Here, m may be a natural number. For example, the scan driver 13 may be configured in the form of a shift register.

The emission driver 14 may receive a clock signal, a control signal, and the like from the timing controller 11 and generate emission signals to be provided to emission lines E1, E2, E3, . . . , Eo. For example, the emission driver 14 may sequentially provide emission signals, each having a turn-off level pulse, to the emission lines E1 to Eo. In another embodiment, the emission driver 14 may sequentially provide emission signals, each having a turn-on level pulse, to the emission lines E1 to Eo. For example, the emission driver 14 may generate emission signals such that a turn-off level pulse or a turn-on level pulse is sequentially delivered to the next stage circuit depending on the clock signal. Here, o may be a natural number greater than zero. For example, the emission driver 14 may be configured in the form of a shift register.

The pixel unit 15 includes pixels. Each pixel PXij may be coupled to a data line, a scan line, and an emission line corresponding thereto. Here, i and j may be natural numbers greater than zero. The pixel PXij may be a pixel circuit, the scan transistor of which is coupled to the i-th scan line and the j-th data line.

Figure 2:
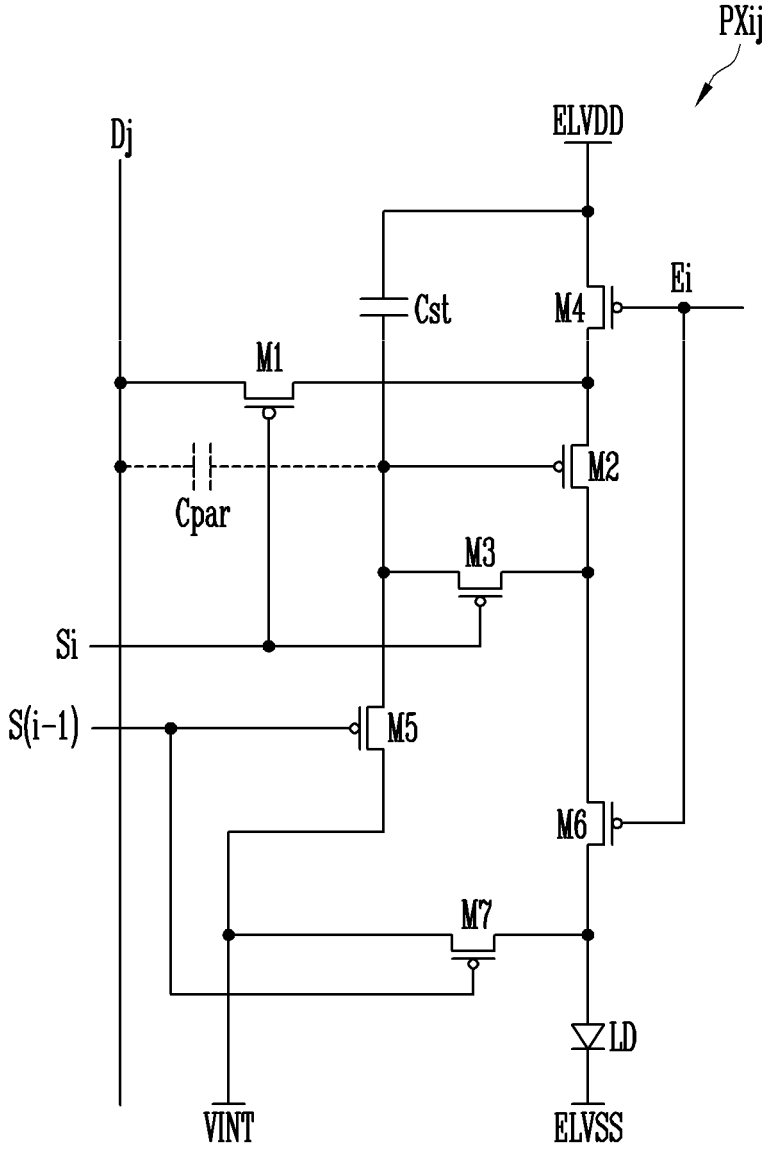
FIG. 2 is a diagram illustrating a pixel according to some example embodiments of the present disclosure.

FIG. 2 is a diagram illustrating a pixel according to some example embodiments of the present disclosure.

Referring to FIG. 2, the pixel PXij according to some example embodiments of the present disclosure may include transistors M1 to M7, a storage capacitor Cst, and a light-emitting diode LD.

In the present embodiment, a description will be made on the assumption that the transistors M1 to M7 are P-type transistors (for example, PMOS). However, those who skilled in the art may configure a pixel circuit that performs the same function by replacing at least some of the transistors M1 to M7 with N-type transistors (for example, NMOS).

The first transistor M1 may be configured such that the gate electrode thereof is coupled to a scan line Si, the first electrode thereof is coupled to a data line Dj, and the second electrode thereof is coupled to the first electrode of the second transistor M2. The first transistor M1 may be referred to as a scan transistor, a switching transistor, or the like.

The storage capacitor Cst may be configured such that the first electrode thereof is coupled to a first power line ELVDD and the second electrode thereof is coupled to the gate electrode of the second transistor M2.

The second transistor M2 may be configured such that the gate electrode thereof is coupled to the second electrode of the storage capacitor Cst, the first electrode thereof is coupled to the second electrode of the first transistor M1, and the second electrode thereof is coupled to the second electrode of the third transistor M3. The second transistor M2 may be referred to as a driving transistor.

The third transistor M3 may be configured such that the gate electrode thereof is coupled to the scan line Si, the first electrode thereof is coupled to the gate electrode of the second transistor M2, and the second electrode thereof is coupled to the second electrode of the second transistor M2. The third transistor M3 may be referred to as a diode-coupled transistor.

The fourth transistor M4 may be configured such that the gate electrode thereof is coupled to an emission line Ei, the first electrode thereof is coupled to the first power line ELVDD, and the second electrode thereof is coupled to the first electrode of the second transistor M2. The fourth transistor M4 may be referred to as an emission control transistor.

The fifth transistor M5 may be configured such that the gate electrode thereof is coupled to a scan line S(i−1), the first electrode thereof is coupled to the gate electrode of the second transistor M2, and the second electrode thereof is coupled to an initialization power line VINT. The fifth transistor M5 may be referred to as a gate initialization transistor.

The sixth transistor M6 may be configured such that the gate electrode thereof is coupled to the emission line Ei, the first electrode thereof is coupled to the second electrode of the second transistor M2, and the second electrode thereof is coupled to the anode of the light-emitting diode LD. The sixth transistor M6 may be referred to as an emission control transistor.

The light-emitting diode LD may be configured such that the anode thereof is coupled to the second electrode of the sixth transistor M6 and the cathode thereof is coupled to a second power line ELVSS. For example, the light-emitting diode LD may be an organic light-emitting diode or an inorganic light-emitting diode.

The seventh transistor M7 may be configured such that the gate electrode thereof is coupled to the scan line S(i−1), the first electrode thereof is coupled to the initialization power line VINT, and the second electrode thereof is coupled to the anode of the light-emitting diode LD. The seventh transistor M7 may be referred to as an anode initialization transistor. According to some example embodiments, the gate electrode of the seventh transistor M7 may be coupled to another scan line.

First, when a scan pulse having a turn-on level is applied through the scan line S(i−1), the transistors M5 and M7 may be turned on. Hereinafter, the turn-on level pulse indicates a pulse having a voltage level that may turn on a transistor to which the corresponding pulse is applied. Here, because the transistors M1 to M7 are P-type transistors, the transistors M1 to M7 may be turned on when a low-level voltage is applied thereto, and may be turned off when a high-level voltage is applied thereto. When the fifth transistor M5 is turned on, the gate electrode of the second transistor M2 is coupled to the initialization voltage line VINT, whereby the voltage at the gate electrode of the second transistor M2 is initialized. Also, when the seventh transistor M7 is turned on, the anode of the light-emitting diode LD is coupled to the initialization voltage line VINT, whereby the light-emitting diode LD is initialized by being discharged or pre-charged. The initialization voltage applied to the initialization voltage line VINT may be the same as the second power voltage applied to the second power line ELVSSS. The second power voltage may have a voltage level lower than the voltage level of the first power voltage applied to the first power line ELVDD.

Subsequently, when a scan pulse having the turn-on level is applied through the scan line Si, the transistors M1 and M3 are turned on. Here, the second transistor M2 may be in the turn-on state because the voltage at the gate electrode thereof is initialized. Therefore, a data signal applied to the data line Dj may be applied to the second electrode of the storage capacitor Cst via the first transistor M1, the second transistor M2, and the third transistor M3. Here, the reduced threshold voltage of the second transistor M2 may be reflected in the voltage of the data signal applied to the second electrode of the storage capacitor Cst.

Subsequently, when an emission signal at the turn-on level is applied to the emission line Ei, the transistors M4 and M6 are turned on, and a driving current path, through which the first power line ELVDD, the fourth transistor M4, the second transistor M2, the sixth transistor M6, the light-emitting diode LD, and the second power line ELVSS are connected, is formed. The light-emitting diode LD emits light with luminance corresponding to the amount of driving current flowing in the driving current path. The amount of driving current may be set depending on the voltage level of the data signal held by the second electrode of the storage capacitor CSt. Here, because the driving current flows via the second transistor M2, the reduced threshold voltage reflected in the data signal, which is held by the second electrode of the storage capacitor Cst, may be compensated. Accordingly, the pixel PXij of the present embodiment enables the driving current to flow regardless of the process deviation with respect to the threshold voltage of the second transistor M2.

However, parasitic capacitance Cpar may be present between the gate electrode of the second transistor M2 and the data line Dj. Accordingly, the voltage level of the data signal, held by the second electrode of the storage capacitor Cst, may be affected by a change in the voltage of the data line Dj. For example, when the voltage of the data line Dj is decreased, the voltage level of the data signal, held by the second electrode of the storage capacitor Cst, may also be decreased. Also, when the voltage of the data line Dj is increased, the voltage level of the data signal, held by the second electrode of the storage capacitor Cst, may be increased. A display defect caused by this will be described in the following embodiment.

Figure 3:
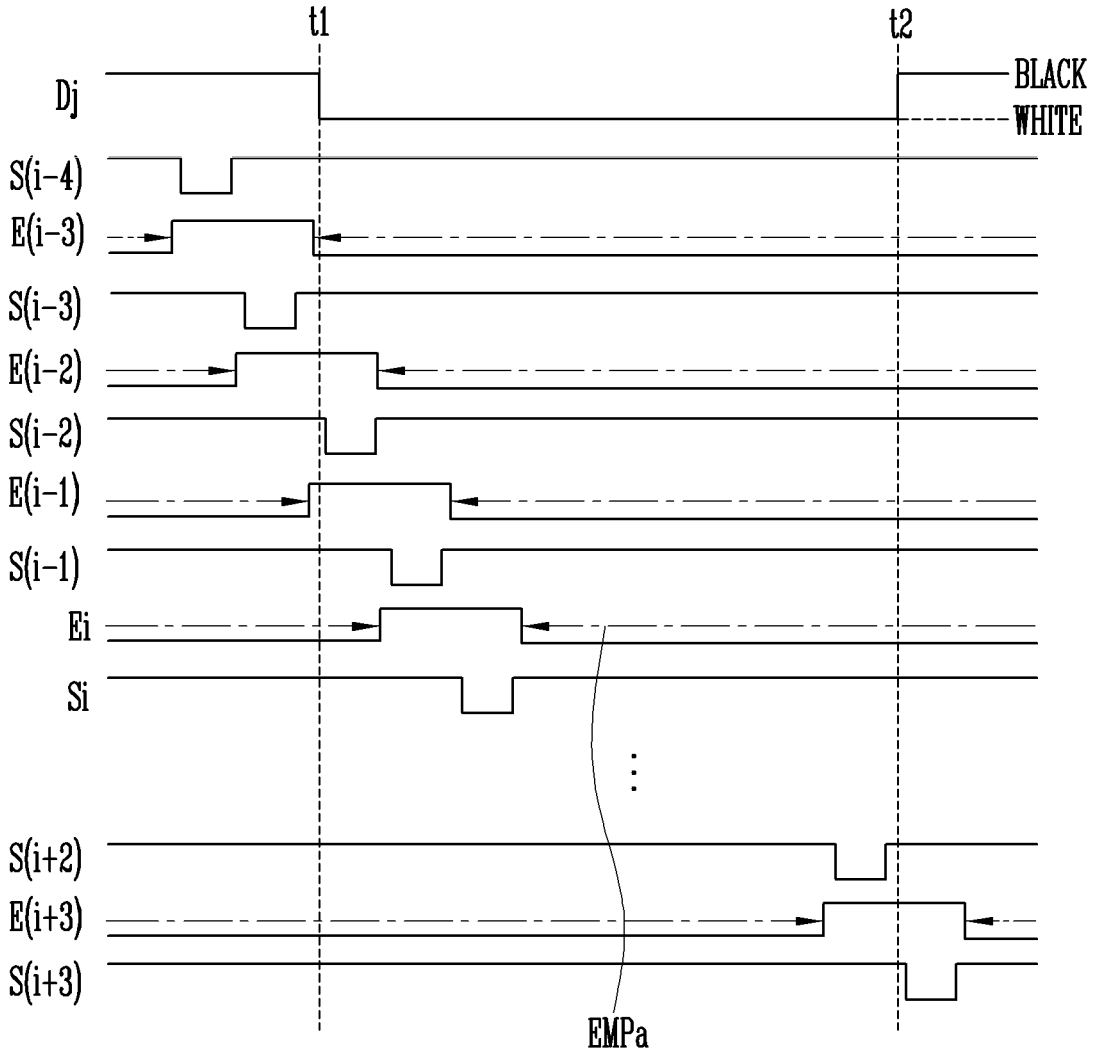
FIGS. 3 and 4 are views illustrating a driving method of a display device according to some example embodiments and the light emission states of pixels according to the driving method of some example embodiments.
Figure 4:
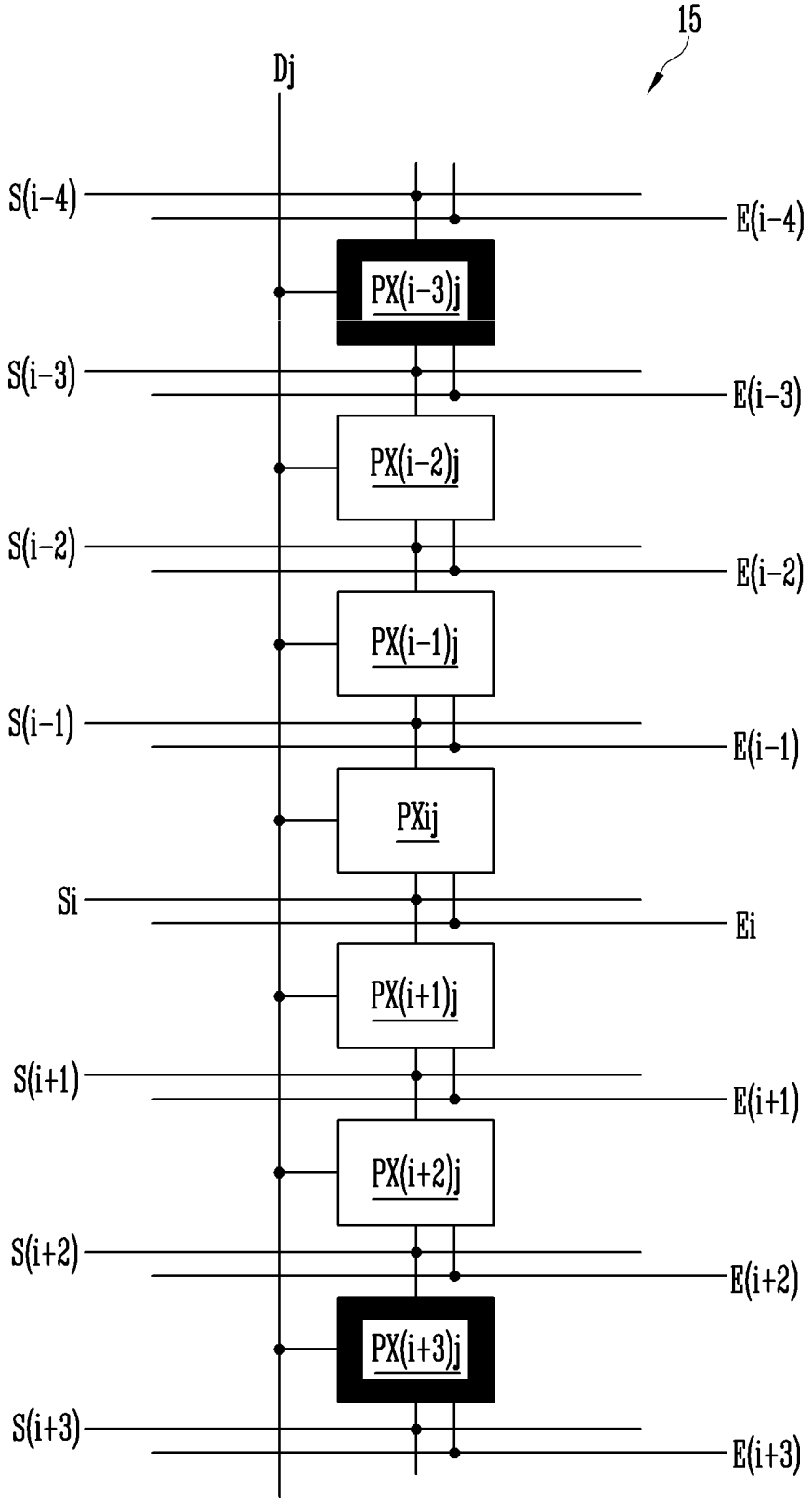

FIGS. 3 and 4 are views illustrating a driving method of a display device according to some example embodiments and the light emission states of pixels according to the driving method of some example embodiments.

In some example embodiments, emission pulses applied to the emission lines E(i−4) to E(i+3) may be turn-off level pulses (high-level pulses). When the emission pulse having the turn-off level is applied to each of the emission lines, the transistors M4 and M6 of each pixel are turned off, and the initialization of each pixel and reception of a data signal may be performed depending on scan pulses. When an emission signal at a turn-on level (a low level) is applied to each of the emission lines, the transistors M4 and M6 are turned on, whereby the pixel corresponding thereto may emit light. An emission period EMPa is represented with an arrow.

For example, with regard to the pixel PX(i−3)j, while an emission pulse having the turn-off level is being applied to the emission line E(i−3), a scan pulse having the turn-on level is applied to the scan line S(i−4) and a scan pulse having the turn-on level is applied to the scan line S(i−3). When the scan pulse having the turn-on level is applied to the scan line S(i−4), the transistors M5 and M7 are turned on, whereby initialization may be performed. Also, when the scan pulse having the turn-on level is applied to the scan line S(i−3), the transistors M1 and M3 are turned on, whereby a data signal may be received. Here, the data line Dj may be in the state in which a data signal corresponding to a black grayscale is applied thereto.

When an emission signal at the turn-on level is applied to the emission line E(i−3), the transistors M4 and M6 are turned on, whereby the pixel PX(i−3)j may emit light with luminance corresponding to a black grayscale. However, while a data signal corresponding to a white grayscale is being applied to the data line Dj in the period between the timepoints t1 and t2, the voltage of the second electrode of the storage capacitor Cst is decreased due to parasitic capacitance Cpar. Accordingly, the pixel PX(i−3)j may emit light with luminance corresponding to a grayscale that is higher than a black grayscale. The same description may be applied to the pixel PX(i+3)j.

The pixels PX(i−2)j, PX(i−1)j, PXij, PX(i+1)j and PX(i+2)j may emit light with luminance corresponding to a white grayscale when emission signals at the turn-on level are applied to the emission lines E(i−2), E(i−1), Ei, E(i+1) and E(i+2) corresponding thereto. However, a data signal corresponding to a black grayscale is applied to the data line Dj before the time point t1 and after the time point t2, and the voltage of the second electrode of the storage capacitor Cst is increased due to parasitic capacitance Cpar, whereby the pixels PX(i−2)j, PX(i−1)j, PXij, PX(i+1)j and PX(i+2)j may emit light with luminance corresponding to a grayscale that is lower than a white grayscale.

The luminance variation of each pixel may correspond to the proportion of the period during which parasitic capacitance Cpar affects the luminance to the emission period EMPa.

However, because the emission period EMPa of each pixel is sufficiently long, the luminance variations of the pixels PX(i−3)j and PX(i+3)j may be similar to each other. That is, the pixels PX(i−3)j and PX(i+3)j may represent similar luminance for a black grayscale. Also, for the same reason, the luminance variations of the pixels PX(i−2)j, PX(i−1)j, PXij, PX(i+1)j and PX(i+2)j may be similar to each other. That is, the pixels PX(i−2)j, PX(i−1)j, PXij, PX(i+1)j and PX(i+2)j may represent similar luminance for a white grayscale.

Consequently, according to the driving method of FIGS. 3 and 4, a user is less likely to recognize the luminance difference, and the pixel unit 15 may be regarded as relatively correctly displaying an image.

Figure 5:
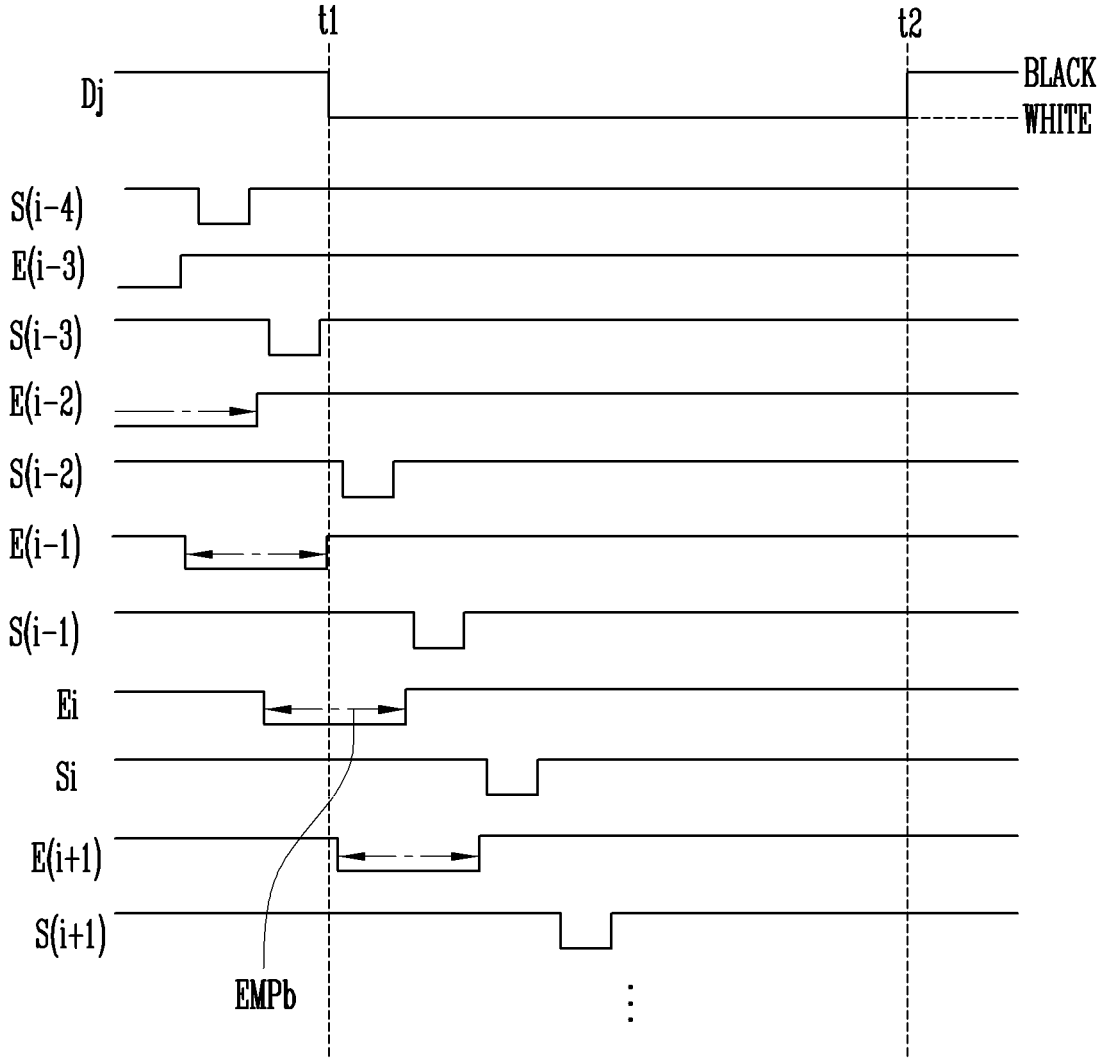
FIGS. 5 and 6 are views illustrating a driving method of a display device according to some example embodiments and the light emission states of pixels according to the driving method of some example embodiments.
Figure 6:
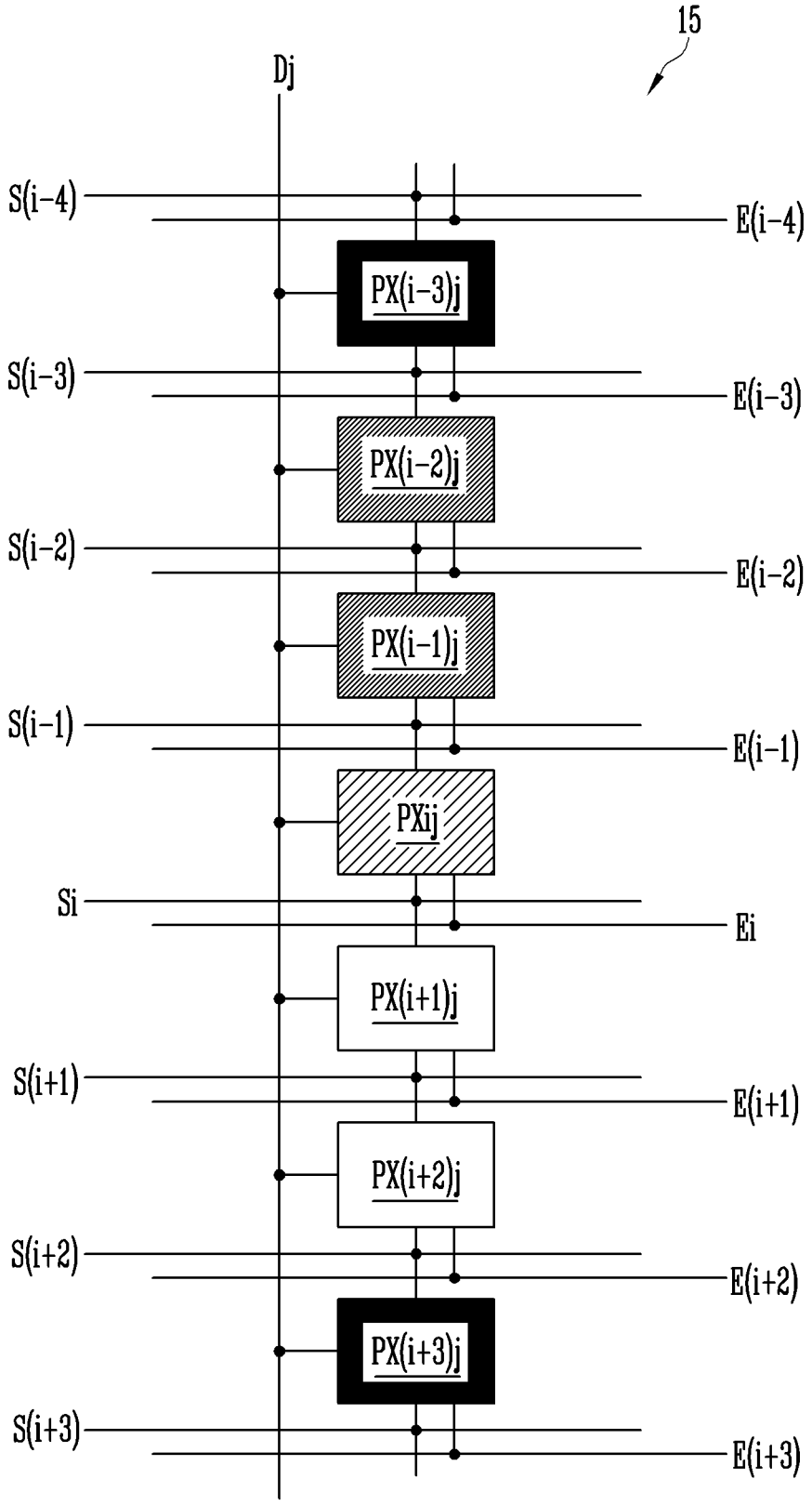

FIGS. 5 and 6 are views illustrating a driving method of a display device according to some example embodiments and the light emission states of pixels according to the driving method of some example embodiments.

In some example embodiments, emission pulses applied to the emission lines E(i−4) to E(i+3) may be turn-on level pulses. When an emission signal at a turn-off level is applied to each of the emission lines, the transistors M4 and M6 of each pixel are turned off, and the initialization of each pixel and reception of a data signal may be performed depending on scan pulses. When the emission pulse having the turn-on level is applied to each of the emission lines, the transistors M4 and M6 are turned on, whereby the pixel corresponding thereto may emit light. The emission period EMPb is represented with an arrow.

In some example embodiments, after an emission pulse having the turn-on level is applied to each pixel, a scan pulse having the turn-on level corresponding thereto may be applied.

In some example embodiments, in order to adjust the maximum luminance of the display device 10 or to increase the amount of driving current for the same luminance, the emission period EMPb may be shorter, compared to the embodiment of FIG. 3 and FIG. 4. Therefore, depending on the degree of overlap between the emission period EMPb and the period during which parasitic capacitance Cpar affects luminance, the relatively large luminance variation may be caused, compared to the embodiment of FIG. 3 and FIG. 4.

For example, in the case of the pixels PX(i−2)j and PX(i−1)j, although a data signal corresponding to a white grayscale is written, emission pulses are generated in the emission lines E(i−2) and E(i−1) before the time point t1, so the pixels PX(i−2)j and PX(i−1)j are affected by parasitic capacitance Cpar during the entire emission period EMPb. Accordingly, the pixels PX(i−2)j and PX(i−1)j may emit light with luminance corresponding to a relatively dark gray grayscale. In some example embodiments, it may be assumed that a data signal having an identical pattern is applied each frame.

Also, the pixel PXij is affected by parasitic capacitance Cpar during part of the emission period EMPb because an emission pulse is generated in the emission line Ei in the period spanning before and after the time point t1. Accordingly, the pixel PXij may emit light with luminance corresponding to a relatively bright gray grayscale.

Meanwhile, the pixels PX(i+1)j and PX(i+2)j are not affected by parasitic capacitance Cpar during the entire emission period EMPb because emission pulses are generated in the emission lines E(i+1) and E(i+2) within the period between the time points t1 and t2. Accordingly, the pixels PX(i+1)j and PX(i+2)j may emit light with luminance corresponding to a white grayscale.

Consequently, according to the driving method of FIG. 5 and FIG. 6, a user may recognize gradation, that is, the pixels PX(i−3)j to PX(i+1)j that become brighter in the order in which they are listed due to the luminance difference. Therefore, the pixel unit 15 may be regarded as incorrectly displaying an image.

Figure 7:
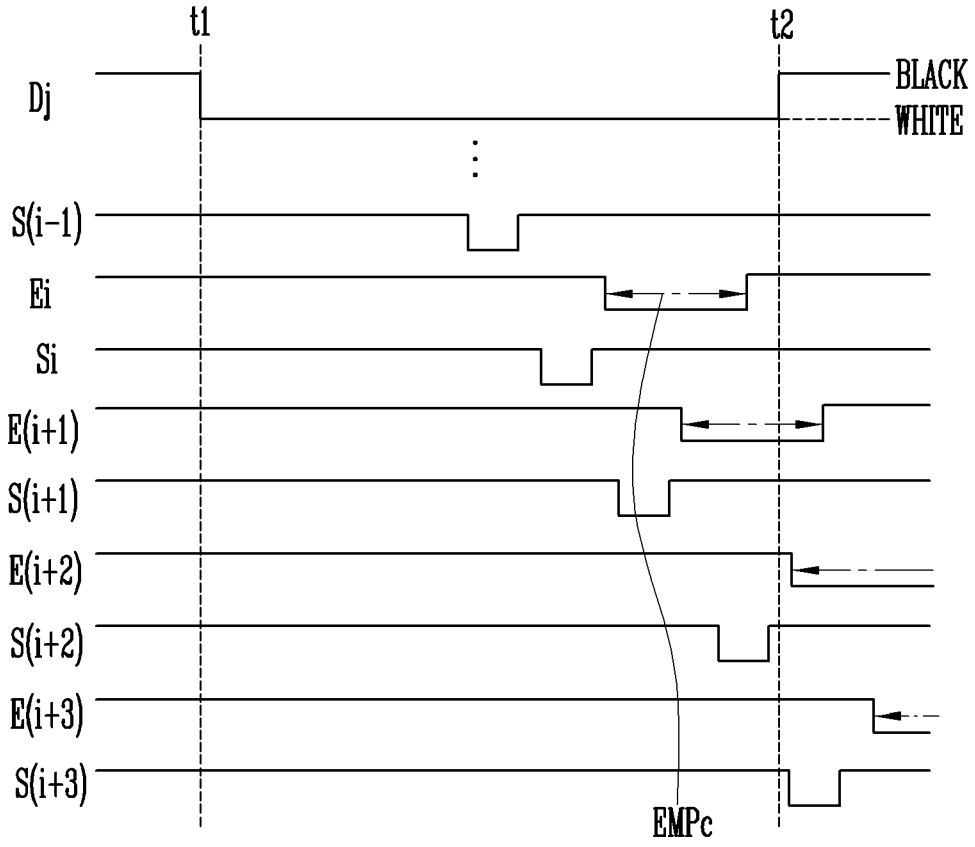
FIGS. 7 and 8 are views illustrating a driving method of a display device according to some example embodiments and the light emission states of pixels according to the driving method of some example embodiments.
Figure 8:
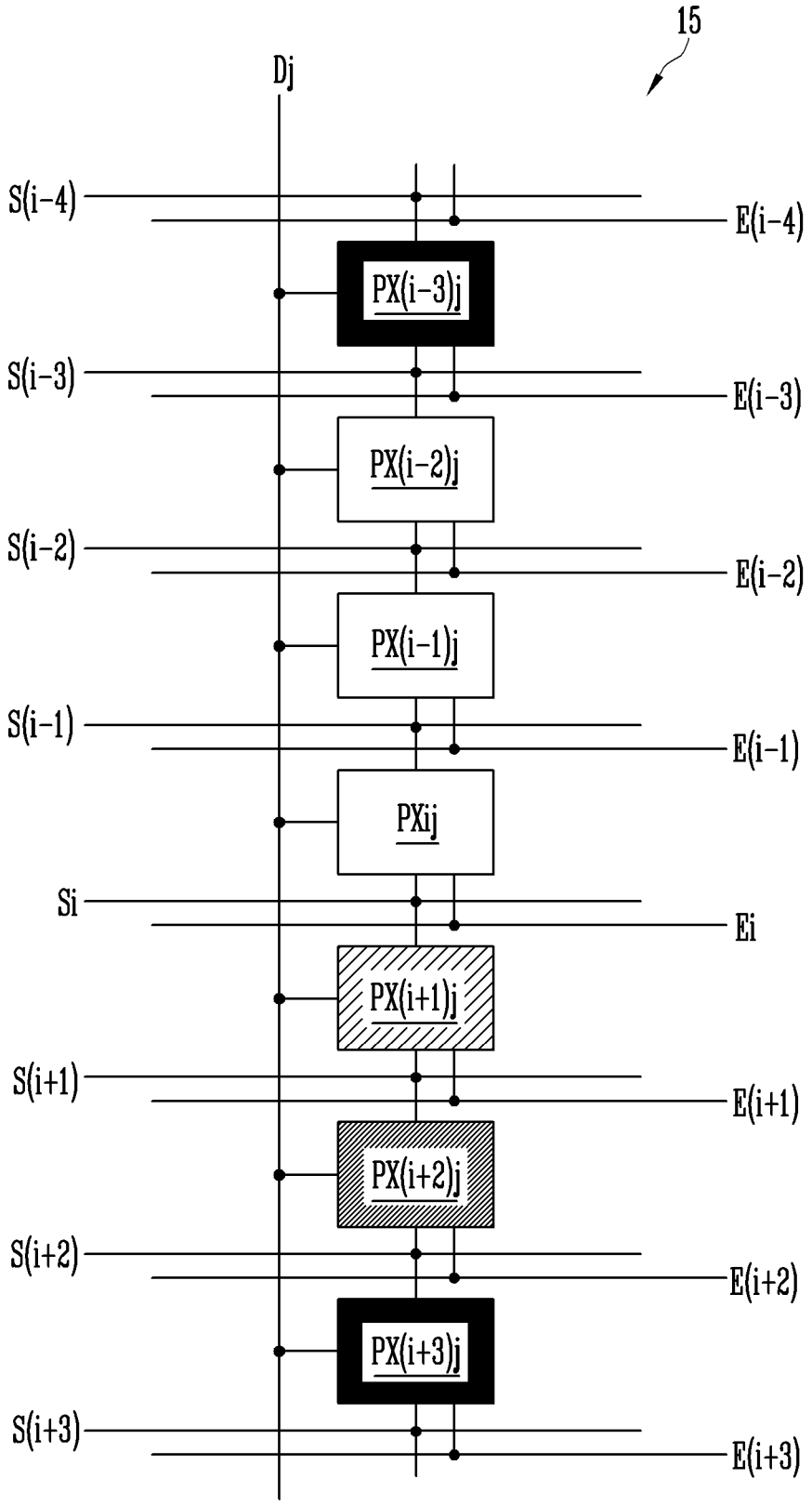

FIGS. 7 and 8 are views illustrating a driving method of a display device according to some example embodiments and the light emission states of pixels according to the driving method of some example embodiments.

In some example embodiments, emission pulses applied to the emission lines E(i−4) to E(i+3) may be turn-on level pulses. When an emission signal at a turn-off level is applied to each of the emission lines, the transistors M4 and M6 of each pixel are turned off, and the initialization of each pixel and reception of a data signal may be performed depending on the scan pulses. When the emission pulse having the turn-on level is applied to each of the emission lines, the transistors M4 and M6 are turned on, whereby the pixel corresponding thereto may emit light. An emission period EMPc is represented with an arrow.

In some example embodiments, after a scan pulse having the turn-on level is applied to each pixel, an emission pulse having the turn-on level may be applied thereto. The length of the emission period EMPc in FIG. 7 may be equal to the length of the emission period EMPb in FIG. 5.

The pixels PX(i−2)j, PX(i−1)j and PXij are not affected by parasitic capacitance Cpar during the entire emission period EMPc because emission pulses are generated in the emission lines E(i−2), E(i−1) and Ei within the period between the time points t1 and t2. Accordingly, the pixels PX(i−2)j, PX(i−1)j and PXij may emit light with luminance corresponding to a white grayscale.

However, the PX(i+1)j is affected by parasitic capacitance Cpar during part of the emission period EMPc because an emission pulse is generated in the emission line E(i+1) in the period spanning before and after the time point t2. Accordingly, the pixel PX(i+1)j may emit light with luminance corresponding to a relatively bright gray grayscale.

Also, the pixel PX(i+2)j is affected by parasitic capacitance Cpar during the entire emission period EMPc because an emission pulse is generated in the emission line E(i+2) after the time point t2. Accordingly, the pixel PX(i+2)j may emit light with luminance corresponding to a relatively dark gray grayscale.

Consequently, according to the driving method of FIG. 7 and FIG. 8, a user may recognize gradation, that is, the pixels PXij to PX(i+3)j that become darker in the order in which they are listed due to the luminance difference. Therefore, the pixel unit 15 may be regarded as incorrectly displaying an image.

Figure 9:
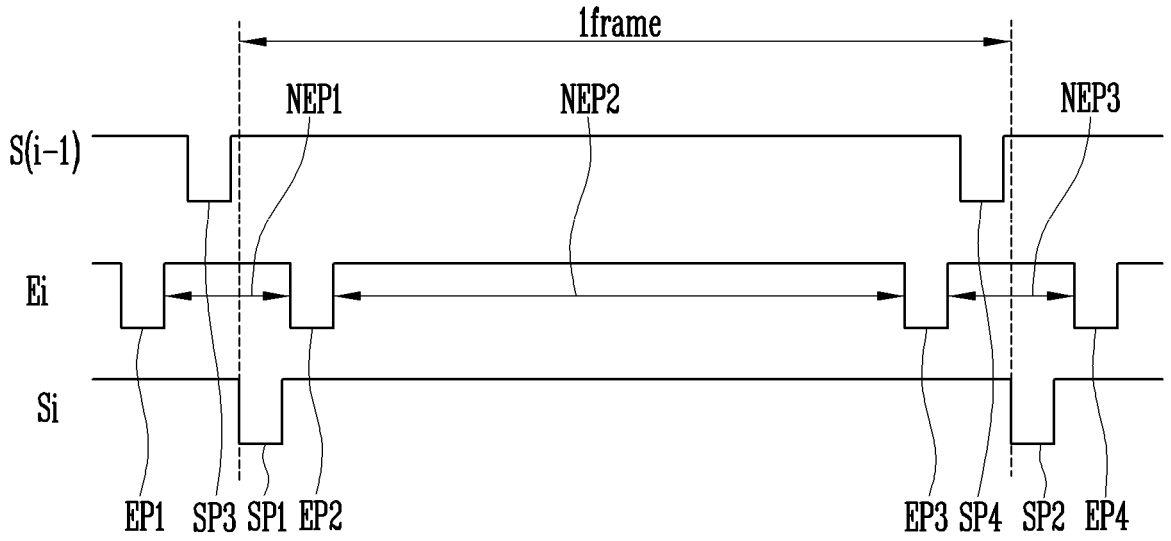
FIGS. 9 to 11 are views illustrating a driving method of a display device according to some example embodiments and the light emission states of pixels according to the driving method of some example embodiments.
Figure 10:
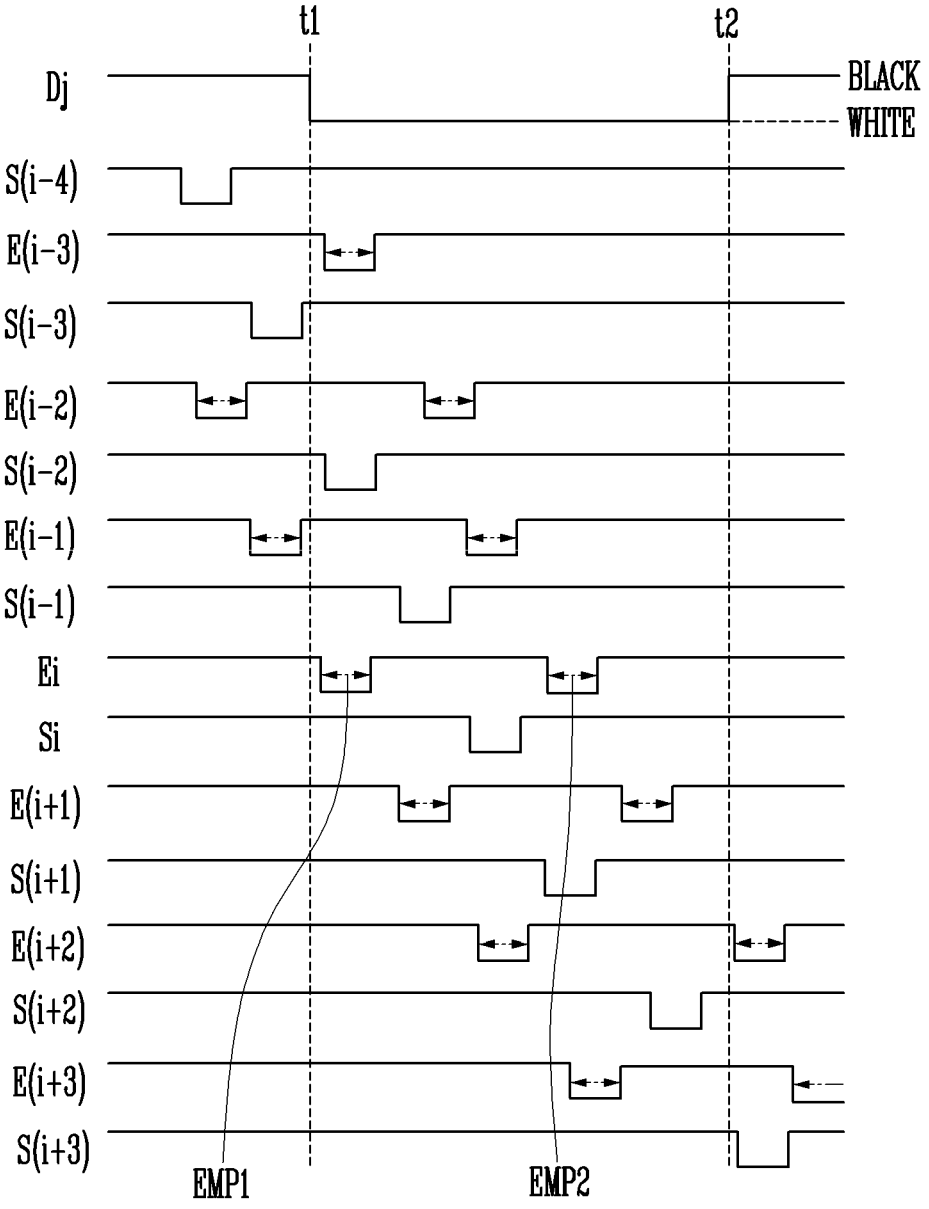
Figure 11:
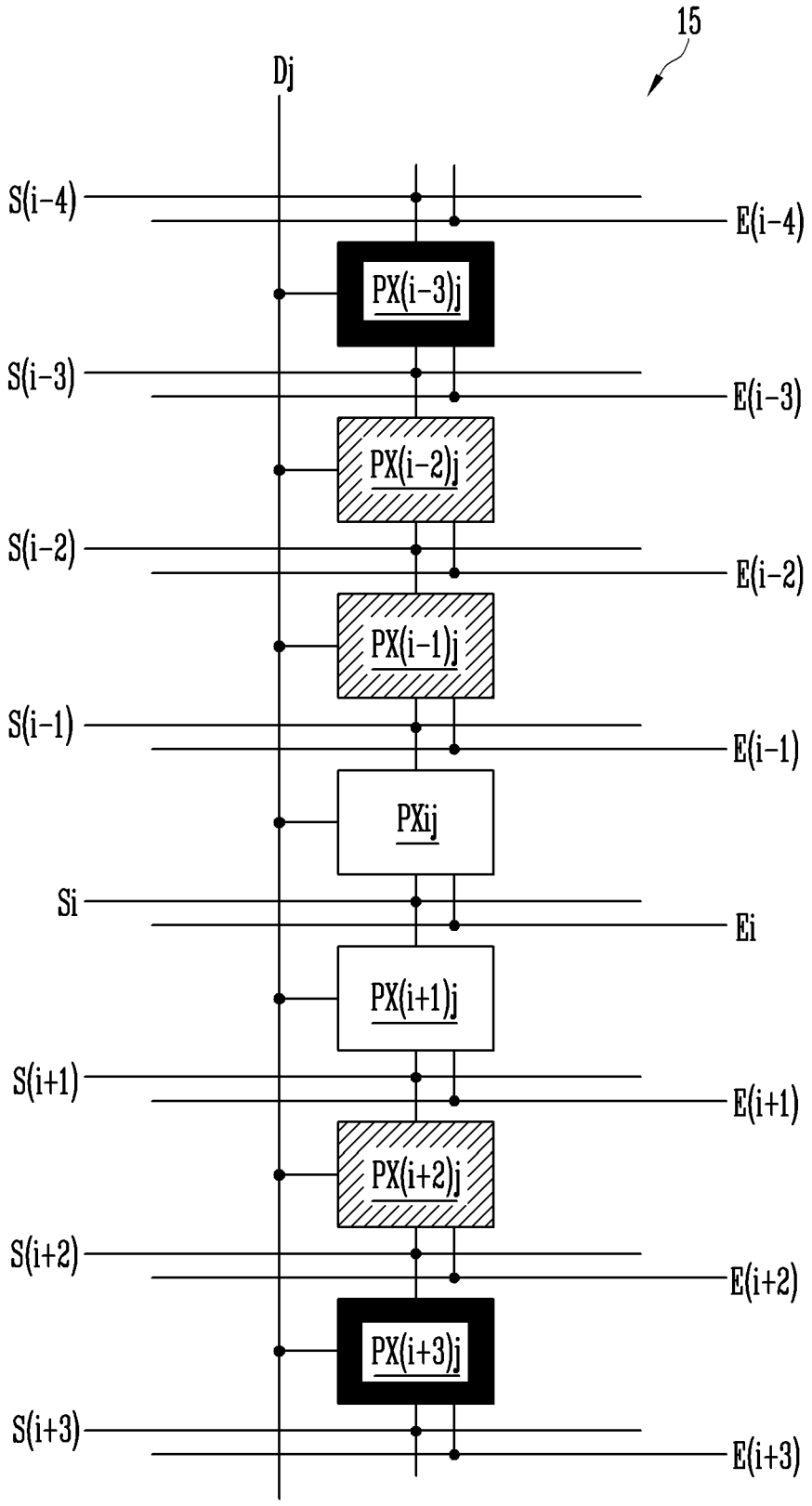

FIGS. 9 to 11 are views illustrating a driving method of a display device according to some example embodiments and the light emission states of pixels according to the driving method of some example embodiments.

First, a description will be made based on a single pixel PXij with reference to FIG. 4 and FIG. 9.

A data signal may be applied to the data line Dj. A first scan pulse SP1 and a second scan pulse SP2, each having a turn-on level, may be sequentially applied to the first scan line Si. A first emission pulse EP1, a second emission pulse EP2, a third emission pulse EP3, and a fourth emission pulse EP4, each having a turn-on level, may be sequentially applied to the emission line Ei. The pixel PXij may receive the data signal when the first and second scan pulses SP1 and SP2 are applied, and may emit light based on the received data signal when the first to fourth emission pulses EP1, EP2, EP3 and EP4 are applied.

Here, the first emission pulse EP1 may be generated before the first scan pulse SP1, the second emission pulse EP2 and the third emission pulse EP3 may be generated in the period between the first scan pulse SP1 and the second scan pulse SP2, and the fourth emission pulse EP4 may be generated after the second scan pulse SP2.

Here, the period between the first emission pulse EP1 and the second emission pulse EP2 may be a first non-emission period NEP1. The period between the second emission pulse EP2 and the third emission pulse EP3 may be a second non-emission period NEP2. The period between the third emission pulse EP3 and the fourth emission pulse EP4 may be a third non-emission period NEP3.

The second non-emission period NEP2 may be longer than each of the first non-emission period NEP1 and the third non-emission period NEP3. The length of the first non-emission period NEP1 may be equal to the length of the third non-emission period NEP3.

A third scan pulse SP3 and a fourth scan pulse SP4, each having the turn-on level, may be sequentially applied to the second scan line S(i−1). The pixel PXij may initialize the received data signal when the third and fourth scan pulses SP3 and SP4 are applied. The third scan pulse SP3 may be generated in the first non-emission period NEP1, and the fourth scan pulse SP4 may be generated in the third non-emission period NEP3.

The first scan pulse SP1 and the second scan pulse SP2 may be generated at intervals of one frame (1 frame), the first emission pulse EP1 and the third emission pulse EP3 may be generated at intervals of one frame, and the second emission pulse EP2 and the fourth emission pulse EP4 may be generated at interval of one frame.

The case in which the above-described driving method is applied to the pixels PX(i−3)j to PX(i+3)j will be described with reference to FIG. 10 and FIG. 11. For example, the first emission pulse EP1 and the second emission pulse EP2 in FIG. 9 may correspond to the first emission period EMP1 and the second emission period EMP2 in FIG. 10, respectively. The sum of the length of the first emission period EMP1 and the length of the second emission period EMP2 may be equal to the length of the above-described emission period EMPb or EMPc.

In each of the emission lines E(i−2), E(i−1) and E(i+2), coupled to the pixels PX(i−2)j, PX(i−1)j and PX(i+2)j, respectively, one emission pulse is generated in the period between the time points t1 and t2, and another emission pulse is generated before or after the period between the time points t1 and t2. Because a data signal corresponding to a white grayscale is written for each of the pixels PX(i−2)j, PX(i−1)j and PX(i+2)j, the emission pulse generated in the period between the time points t1 and t2 is not affected by parasitic capacitance Cpar, but the emission pulse generated before or after the period between the time points t1 and t2 may be affected by parasitic capacitance Cpar. Accordingly, the pixels PX(i−2)j, PX(i−1)j and PX(i+2)j may emit light with luminance corresponding to a relatively bright gray grayscale.

In each of the emission lines Ei and E(i+1), coupled to the pixels PXij and PX(i+1)j, respectively, all of the two emission pulses are generated in the period between the time points t1 and t2. Because a data signal corresponding to white grayscale is written for each of the pixels PXij and PX(i+1)j, no emission pulse is affected by parasitic capacitance Cpar. Accordingly, the pixels PXij and PX(i+1)j may emit light with luminance corresponding to a white grayscale.

According to some example embodiments, an emission pulse having the turn-on level is divided into at least two emission pulses, and the at least two emission pulses are generated before and after the scan pulse corresponding thereto, whereby the effect of parasitic capacitance Cpar depending on the location of a pixel may be distributed.

Therefore, the luminance difference between pixels corresponding to a white grayscale may be reduced, compared to the cases of FIG. 6 and FIG. 8, and a user may recognize that the pixel unit 15 displays an image correctly.

Figure 12:
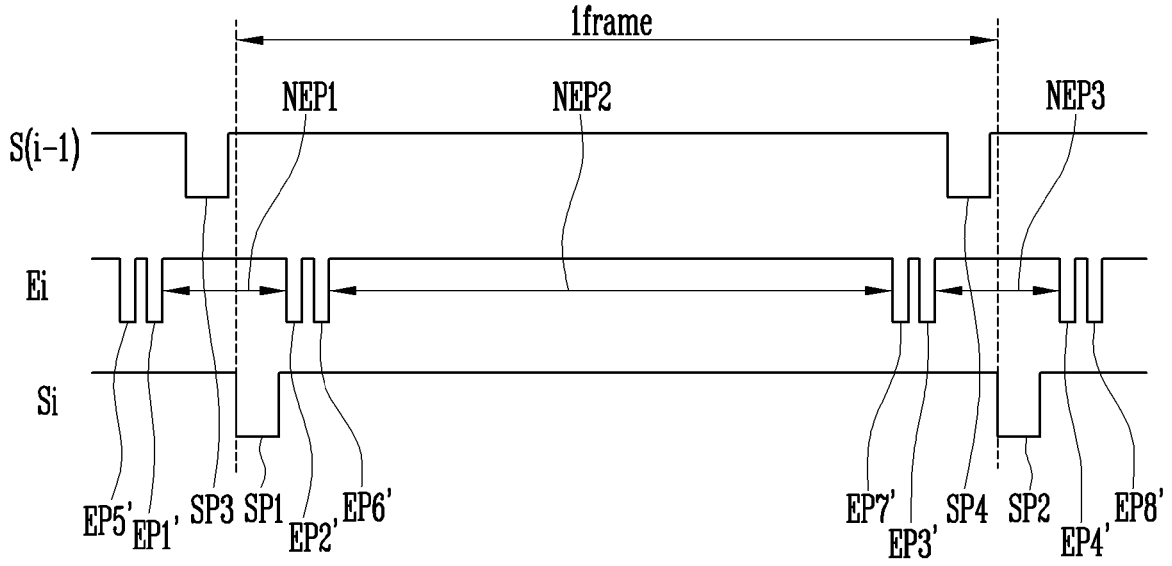
FIG. 12 is a view illustrating a driving method of a display device according to some example embodiments of the present disclosure.

FIG. 12 is a view illustrating a driving method of a display device according to some example embodiments.

Referring to FIG. 12, additional emission pulses EP5', EP6', EP7' and EP8' may be generated in the emission line Ei, unlike the case of FIG. 9.

For example, in the emission line Ei, the fifth emission pulse EP5' may be generated before the first emission pulse EP1', the sixth emission pulse EP6' and the seventh emission pulse EP7' may be sequentially generated in the period between the second emission pulse EP2' and the third emission pulse EP3', and the eighth emission pulse EP8' may be generated after the fourth emission pulse EP4'.

For example, the sum of the widths of the first emission pulse EP1' and the fifth emission pulse EP5' in FIG. 12 may be equal to the width of the first emission pulse EP1 in FIG. 9, and the sum of the widths of the second emission pulse EP2' and the sixth emission pulse EP6' in FIG. 12 may be equal to the width of the second emission pulse EP2 in FIG. 9. Also the sum of the widths of the seventh emission pulse EP7' and the third emission pulse EP3' in FIG. 12 may be equal to the width of the third emission pulse EP3 in FIG. 9, and the sum of the widths of the fourth emission pulse EP4' and the eighth emission pulse EP8' in FIG. 12 may be equal to the width of the fourth emission pulse EP4 in FIG. 9.

According to some example embodiments, although the number of emission pulses is increased, an effect similar to the effect of the embodiment of FIGS. 9 to 11 may be achieved.

A display device and a driving method thereof according to some example embodiments of the present disclosure may reduce display defects in spite of parasitic capacitance between a data line and a pixel.

Although specific terms have been used in the present specification, these are merely intended to describe aspects of some example embodiments of the present disclosure, and are not intended to limit the meanings thereof or the scope of the present disclosure described in the accompanying claims, and their equivalents. Therefore, those skilled in the art will appreciate that various modifications and other equivalent embodiments are possible from the embodiments. Therefore, the technical scope of the present disclosure should be defined by the technical spirit of the claims and their equivalents.

What is claimed is:

1. A display device, comprising:

a data line configured to receive a data signal;

a first scan line configured to sequentially receive a first scan pulse and a second scan pulse, each of which has a turn-on level;

an emission line configured to sequentially receive a first emission pulse, a second emission pulse, a third emission pulse, and a fourth emission pulse, each of which has a turn-on level; and a pixel configured to receive the data signal through the data line according to the first and second scan pulses, each of which has the turn-on level, the pixel being further configured to emit light based on the received data signal according to the first to fourth emission pulses, wherein the first emission pulse is generated before the first scan pulse, the second emission pulse and the third emission pulse are generated in a period between the first scan pulse and the second scan pulse, and the fourth emission pulse is generated after the second scan pulse, and wherein:

a period between the first emission pulse and the second emission pulse is a first non-emission period, a period between the second emission pulse and the third emission pulse is a second non-emission period, and a period between the third emission pulse and the fourth emission pulse is a third non-emission period.

2. The display device according to claim 1, wherein the second non-emission period is longer than each of the first non-emission period and the third non-emission period.

3. The display device according to claim 2, wherein a length of the first non-emission period is equal to a length of the third non-emission period.

4. The display device according to claim 3, wherein the pixel comprises:

a first transistor having a gate electrode coupled to the first scan line and a first electrode coupled to the data line;

a storage capacitor having a first electrode coupled to a first power line;

a second transistor having a gate electrode coupled to a second electrode of the storage capacitor and a first electrode coupled to a second electrode of the first transistor;

a third transistor having a gate electrode coupled to the first scan line, a first electrode coupled to the gate electrode of the second transistor, and a second electrode coupled to a second electrode of the second transistor; and a fourth transistor having a gate electrode coupled to the emission line, a first electrode coupled to the first power line, and a second electrode coupled to the first electrode of the second transistor.

5. The display device according to claim 4, further comprising:

a second scan line configured to sequentially receive a third scan pulse and a fourth scan pulse, each of which has a turn-on level, wherein the pixel is configured to initialize the received data signal in response to the third and fourth scan pulses, and wherein the third scan pulse is generated in the first non-emission period, and the fourth scan pulse is generated in the third non-emission period.

6. The display device according to claim 5, wherein the pixel further comprises:

a fifth transistor having a gate electrode coupled to the second scan line, a first electrode coupled to the gate electrode of the second transistor, and a second electrode coupled to an initialization power line;

a sixth transistor having a gate electrode coupled to the emission line and a first electrode coupled to the second electrode of the second transistor; and a light-emitting diode having an anode coupled to a second electrode of the sixth transistor and a cathode coupled to a second power line.

7. The display device according to claim 6, wherein the pixel further comprises:

a seventh transistor having a gate electrode coupled to the second scan line, a first electrode coupled to the initialization power line, and a second electrode coupled to the anode of the light-emitting diode.

8. The display device according to claim 7, wherein:

the first scan pulse and the second scan pulse are generated at intervals of one frame, the first emission pulse and the third emission pulse are generated at intervals of one frame, and the second emission pulse and the fourth emission pulse are generated at intervals of one frame.

9. A display device, comprising:

a data line configured to receive a data signal;

a first scan line configured to sequentially receive a first scan pulse and a second scan pulse, each of which has a turn-on level;

an emission line configured to sequentially receive a first emission pulse, a second emission pulse, a third emission pulse, and a fourth emission pulse, each of which has a turn-on level; and a pixel configured to receive the data signal through the data line according to the first and second scan pulses, each of which has the turn-on level, the pixel being further configured to emit light based on the received data signal according to the first to fourth emission pulses, wherein the first emission pulse is generated before the first scan pulse, the second emission pulse and the third emission pulse are generated in a period between the first scan pulse and the second scan pulse, and the fourth emission pulse is generated after the second scan pulse, and wherein:

in the emission line, a fifth emission pulse is generated before the first emission pulse, a sixth emission pulse and a seventh emission pulse are sequentially generated in a period between the second emission pulse and the third emission pulse, and an eighth emission pulse is generated after the fourth emission pulse.

10. A driving method of a display device, the method comprising:

applying a first emission pulse having a turn-on level to an emission line such that a pixel emits light;

applying a first scan pulse having a turn-on level to a first scan line such that the pixel receives a data signal through a data line;

applying a second emission pulse and a third emission pulse, each of which has a turn-on level, to the emission line such that the pixel emits light based on the received data signal;

applying a second scan pulse having a turn-on level to the first scan line such that the pixel receives the data signal; and applying a fourth emission pulse having a turn-on level to the emission line such that the pixel emits light based on the received data signal, wherein the first emission pulse is generated before the first scan pulse, wherein the second emission pulse and the third emission pulse are generated in a period between the first scan pulse and the second scan pulse, wherein the fourth emission pulse is generated after the second scan pulse, and wherein:

a period between the first emission pulse and the second emission pulse is a first non-emission period, a period between the second emission pulse and the third emission pulse is a second non-emission period, and a period between the third emission pulse and the fourth emission pulse is a third non-emission period.

11. The driving method according to claim 10, wherein the second non-emission period is longer than each of the first non-emission period and the third non-emission period.

12. The driving method according to claim 11, wherein a length of the first non-emission period is equal to a length of the third non-emission period.

13. The driving method according to claim 12, further comprising:

sequentially applying a third scan pulse and a fourth scan pulse, each of which has a turn-on level, to a second scan line that differs from the first scan line such that the pixel initializes the received data signal, wherein the third scan pulse is generated in the first non-emission period, and wherein the fourth scan pulse is generated in the third non-emission period.

14. The driving method according to claim 12, wherein:

the first scan pulse and the second scan pulse are generated at intervals of one frame, the first emission pulse and the third emission pulse are generated at intervals of one frame, and the second emission pulse and the fourth emission pulse are generated at intervals of one frame.

15. The driving method according to claim 10, further comprising:

generating a fifth emission pulse, a sixth emission pulse, a seventh emission pulse, and an eighth emission pulse in the emission line, wherein the fifth emission pulse is generated before the first emission pulse, the sixth emission pulse and the seventh emission pulse are sequentially generated in a period between the second emission pulse and the third emission pulse, and the eighth emission pulse is generated after the fourth emission pulse.

* * * * *